US007886447B2

(12) United States Patent
Cruz

(10) Patent No.: US 7,886,447 B2
(45) Date of Patent: Feb. 15, 2011

(54) VEHICLE VISOR MEASURING AND CUTTING APPARATUS

(76) Inventor: Juan Manual Cruz, 855 S. 84th St., West Allis, WI (US) 53214

( * ) Notice: Subject to any disclaimer, the term of this patent is extended or adjusted under 35 U.S.C. 154(b) by 175 days.

(21) Appl. No.: 12/329,574

(22) Filed: Dec. 6, 2008

(65) Prior Publication Data

US 2010/0139009 A1 Jun. 10, 2010

(51) Int. Cl.
*B43L 13/02* (2006.01)

(52) U.S. Cl. ..... 33/41.5; 33/32.2; 33/485; 33/812

(58) Field of Classification Search ..... 33/32.1, 33/32.2, 32.3, 41.1, 41.5, 41.6, 403, 484, 33/485, 486, 783, 810, 811, 812
See application file for complete search history.

(56) References Cited

U.S. PATENT DOCUMENTS

| | | | | | |
|---|---|---|---|---|---|
| 271,306 | A | * | 1/1883 | Brah | 33/32.2 |
| 3,286,351 | A | * | 11/1966 | McAllister | 33/42 |
| 3,924,327 | A | | 12/1975 | Edwards | |
| 3,995,521 | A | | 12/1976 | Raphael | |
| 4,244,253 | A | | 1/1981 | Flanigan | |
| 4,507,869 | A | * | 4/1985 | Stude | 33/42 |
| 4,730,399 | A | * | 3/1988 | Campbell | 33/810 |
| 4,750,537 | A | | 6/1988 | Green | |
| 4,809,439 | A | | 3/1989 | Burns | |
| 4,986,152 | A | | 1/1991 | Sammons | |
| 5,309,642 | A | * | 5/1994 | McGinnis | 33/32.2 |
| 5,394,605 | A | | 3/1995 | Fattori et al. | |
| 5,400,510 | A | | 3/1995 | Glodowski | |
| 5,648,034 | A | | 7/1997 | Van de Velde Keyser | |
| 5,651,184 | A | | 7/1997 | Tutty | |
| 2003/0145476 | A1 | * | 8/2003 | Chen | 33/484 |
| 2007/0251361 | A1 | | 11/2007 | Ogston | |

* cited by examiner

*Primary Examiner*—G. Bradley Bennett
(74) *Attorney, Agent, or Firm*—Absolute Technology Law Group LLC

(57) ABSTRACT

A vehicle visor measuring and cutting apparatus generally comprised of a measuring component, an implement holder, a handle, and a contour guide. The adjustable implement holder is positioned along a portion of window film on a windshield relative to the contour guide, which juxtaposes the windshield molding, and is moved across the windshield, measuring or cutting a portion of window film to the desired dimensions and compensating for any contours and arcs in the windshield.

20 Claims, 2 Drawing Sheets

VEHICLE VISOR MEASURING AND CUTTING APPARATUS

FIELD OF INVENTION

This invention relates generally to the field of window film installation, and in particular for a tool for installing window film that compensates for the curvature of a windshield and complies with state law requirements for window tint visor dimensions.

BACKGROUND

It is estimated that there are more than 100,000 businesses engaged in the occupation of applying window tint to vehicle windshields. Applying a vehicle tinted windshield visor is a time intensive, exacting operation. The purpose of window tint is generally to protect the interior and occupants from harmful ultraviolet rays and glare. Window tinting keeps vehicles cooler and more comfortable for the occupants and also has limited insulating qualities.

Additionally, "anti-shatter" film may be applied to glass with the primary benefit of reducing the risk of injury from cutting and piercing. Reducing damage to property is a secondary but important benefit. These films are made of heavy-gauge plastic and are intended to retain broken glass fragments when subject to impact.

Two broad categories of materials are most often used for window film. Polyester based products are used for all types of applications. Vinyl products are almost exclusively used within buildings.

Window tinting may be performed by the vehicle manufacturer, but is often performed by after-market specialists and occasionally by lay vehicle operators. The process generally includes: (1) cleaning the interior window; (2) covering the window with window film from the interior and securing it temporarily in place with a soap and water mixture; (3) physically cutting (or measuring to be cut) the window film to fit the area to be covered; (4) carefully removing the window film template; (5) applying the tinting film to the window; (6) removing any extraneous film material from the interior of the window and cleaning both the interior surface of the window and the surrounding vehicle, as necessary.

For many specialists and lay vehicle operators, cutting the window film to the correct dimensions is a difficult and time-consuming part of applying the window tint, particularly when cutting for front or rear windshields, which are typically arced or contoured.

In general, there are two methods used for cutting windshield tint that account for the curvature of the windshield so that material lies flat and does not wrinkle, buckle or come loose. The first method is to manually measure the dimensions of window film necessary, apply markings along those dimensions on the windshield itself (such as masking tape), position window film over applied markings and cut to the correct dimensions. A person can make a template using this model, to be used on cars having the same windshields. This process is time consuming for each vehicle and can require many templates to be efficient. Alternatively, a plotter (which is a tool that measures curves, prints and cuts) may be used to compensate for arc. A plotter is an extremely expensive, non-portable type of computer equipment (costing from $7,000-10,000) and there are limitations in programming that do not allow for variations in dimensions for all windshields on the market without distortion.

It is also important to note that vehicle window tinting is heavily regulated by state law. Automobile window tinting reduces the visible light transmission (VLT) through car windows and this diminishes night visibility. It also effects the ability of law enforcement, security and emergency personnel to be able to identify the passengers in a vehicle.

In particular, state visor laws regulate the width of the "visor portion" which is the strip of window tint applied to the front of a windshield. This width measurement is taken from the top of the windshield to the bottom of the visor portion (also known in the art as an "eyebrow").

It is desirable to have an efficient, inexpensive tool to measure visors so that they are in compliance with state visor limit laws.

It is also desirable to have an efficient, inexpensive tool that mathematically compensates for the contour of a windshield for a wide range of makes and models of cars.

GLOSSARY

As used herein, the term "window film" refers to a cover, coating, glazing or tinting product known in the art, made from polyester or vinyl to cover, strengthen or tint windows.

As used herein, the term "standard window film width allowances" refer to various state laws that are enacted to limit the width of the visor on the front or rear windshield of a vehicle.

As used herein, the term "ball bearing" or "gliding member" refers to any rolling element, such as a ball bearing or wheel that allows for continuous rolling and/or gliding movement over a surface.

As used herein, the term "contour guide" refers to an object that is positioned with reference the upper edge of a vehicle windshield and/or the molding that encases it. The contour guide compensates for the contour of a specific windshield during the cutting process.

As used herein, the term "handle" refers to a component used to facilitate gripping or which may serve as an attachment point to a machine. In various embodiments a handle may anthropometrically and/or ergonomically designed to facilitate gripping, or aid in secure attachment and efficient mechanical movement.

As used herein, the term "measurement marking" refers to at least one marking conforming to any of the various units of measurement (such as inches, centimeters, millimeters, etc.) or of other measurements. For example, measurement markings may be used to measure the distance from windshield molding and/or the overall width of a window visor.

As used herein, the term "marking tool" refers to any object capable of leaving a uniform mark on a section of window film, such as a pen, crayon or pencil.

As used herein, the term "visor" or "windshield visor" means a strip of tint film at the top of a front windshield.

As used herein the terms "selectively attached" or "selectively positioned" mean removable or capable of being repositioned.

SUMMARY OF THE INVENTION

The present vehicle visor measuring and cutting apparatus, and is comprised of a measuring component, an implement holder, a handle, and a contour guide. The adjustable implement holder is positioned along an elongated structure that is referred to as the measuring component. A contour guide and implement extend at an approximate ninety degree angle from the measuring component, and are proportional in length to each other, with the implement protruding further (e.g., one-eighth to one-half inch). The contour guide is positioned along the upper molding of the windshield and moved across the windshield thus positioning the implement to cut or mark the window tint film as the device is moved, thus compensating for any contours and arcs in the windshield. In various embodiments this tool may be used manually, or as a component of a robotic or mechanical device.

DETAILED DESCRIPTION OF EMBODIMENTS OF THE INVENTION

Figure 1:
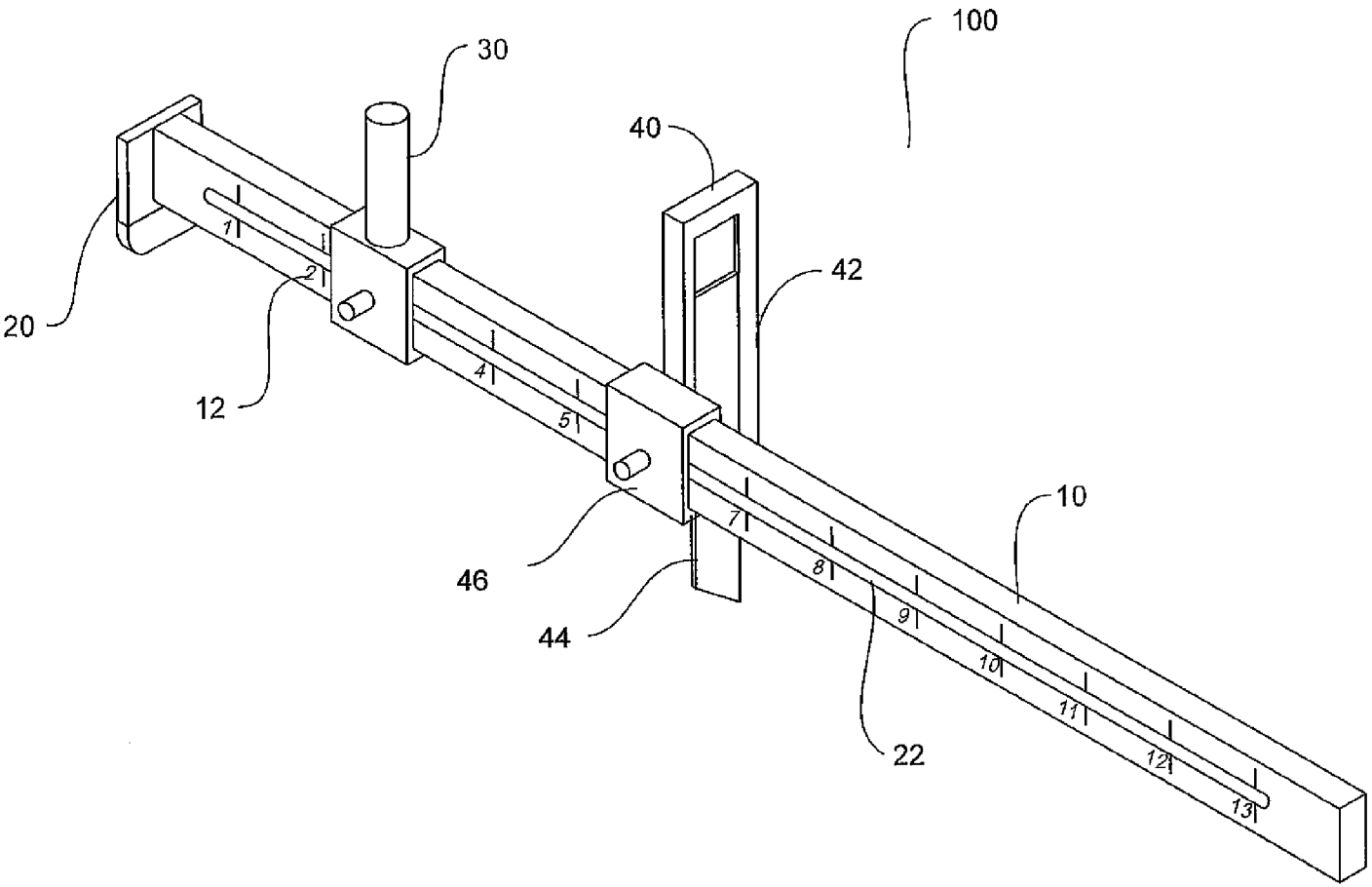
FIG. 1 shows an isometric perspective view of one embodiment of the vehicle visor measuring and cutting apparatus.

For the purpose of promoting an understanding of the present invention, references are made in the text hereof to embodiments of a vehicle visor measuring and cutting apparatus, only some of which are described herein. It should nevertheless be understood that no limitations on the scope of the invention are thereby intended. One of ordinary skill in the art will readily appreciate that there may be modifications such as the dimensions of a vehicle visor measuring and cutting apparatus. Alternate but functionally similar material (s) may be used. The inclusion of additional elements may be deemed readily apparent and obvious to one of ordinary skill in the art, and all equivalent relationships to those described in the written description do not depart from the spirit and scope of the present invention. Some of these possible modifications are mentioned in the following description. Therefore, specific details disclosed herein are not to be interpreted as limiting, but rather as a basis for the claims and as a representative basis for teaching one of ordinary skill in the art to employ the present invention in virtually any appropriately detailed apparatus or manner.

It should be understood that the drawings are not necessarily to scale, emphasis instead being placed upon illustrating the principles of the invention. In addition, in the embodiments depicted herein, like reference numerals in the various drawings refer to identical or near identical structural elements.

Moreover, the term "substantially" or "approximately" as used herein may be applied to modify any quantitative representation that could permissibly vary without resulting in a change in the basic function to which it is related. For example, one embodiment of the vehicle visor measuring and cutting apparatus as disclosed herein may be comprised of a single multi-dimensional and/or textured component, while others may include multiple multi-dimensional and/or textured component.

Referring now to the drawings, FIG. 1 shows an isometric perspective view of vehicle visor measuring and cutting apparatus 100, which includes measuring component 10, implement holder 40, handle 30 and contour guide 20. In the embodiment shown in FIG. 1, measuring component 10 is an elongated structure with a length of approximately 10 to 16 inches and a width of a quarter to one inch.

Implement holder 10 is adapted to hold a stainless steel cutting blade (because stainless steel blades do not cut glass). In other embodiments, implement holder 10 may be adapted to hold another type of cutting blade, a marking device, a laser device, a rotary cutting device or any other cutting or marking tool known in the art.

FIG. 1 also illustrates measurement markings 12 on measuring component 10, which in the exemplary embodiment are markings engraved on measuring component 10 to designate inches. Measurement markings 12 may include one or more designations for any variety of measurements known in the art, such as inches, fractions of inches, centimeters, millimeters, etc. In addition to generally known measurement designations, measurement markings 12 may include designations for particular state-specific standard window film width allowances. In various embodiments, measurement markings 12 may be engraved, painted, stenciled, carved or otherwise demarcated on measuring component 10, and may contain edges, divots, holes, cutouts or other marks to facilitate easy marking on a window. In still other embodiments, measurement markings 12 may be markings corresponding to dimensions that will make cut visors compliant with state laws.

In the exemplary embodiment shown in FIG. 1, measuring component 10 is formed from steel alloy, but in various embodiments may be constructed from metal, wood or plastic, and may contain edges, divots, holes, cutouts, marks, engravings, apertures for hanging, straps, magnets or other elements known in the art.

The exemplary embodiment shown in FIG. 1 also includes implement holder 40, which is affixed to measuring component 10 by attachment member 46. In the embodiment shown, attachment member 46 is a bracket that partially encases attachment member 10 and allows implement holder 40 to move slidably. In the embodiment shown implement 44 is positioned substantially perpendicular to measuring component 10, and securely mounted within implement holder 42. Implement 42 may be replaced and exchanged, and may be interchangeable with various types of implements.

In the embodiment illustrated in FIG. 1, implement 44 is a stainless steel blade positioned with its cutting blade at an approximate degree angle and is pointed at angle ranging from 25 to 75 degrees (but most commonly at an approximate 45 degree angle.)

In other embodiments, implement 44 may be a marking tool (not shown), such as a pen, dye, chalk, electronic marking device, rotary device crayon or pencil or other implement to mark the preferred dimensions of the window film.

In the embodiment shown, implement holder 42 securely holds implement 44 in position to allow for substantially accurate cutting and/or marking. Attachment member 46, and also provides an adjustment mechanism that allows implement 44 to be slidably retracted or extended to various settings to compensate for different windshield contours or arcs and to be stored when vehicle visor measuring and cutting apparatus 100 is not in use. In the exemplary embodiment, implement holder 42 is made from molded plastic, but in alternate embodiments, may be made from steel or other metals, composites, alloys, or any other material that securely holds and allows for slidably adjustment of implement 44. In various embodiments, implement casing 42 may be fixedly attached or may be integrally manufactured and/or molded with a cutting or marking implement, or to measuring component 10. As shown in the embodiment in FIG. 1, measuring component attachment 46 is slidably attached to measuring component 10 and is also securely attached to implement holder 42. In the exemplary embodiment, measuring component attachment 46 is molded plastic, but in alternate embodiments can be made from steel or other metals, composites, alloys, or any other material that securely holds and allows for slidably adjustment against measuring component 10, or may be integrally molded and constructed with implement holder 42 and/or measuring component 10. In the embodiment shown in FIG. 1, measuring component attachment 46 is adjusted and secured using an adjustable screw or screw set screw 48, but in alternate embodiments, may be any securely adjustable mechanism such as a clip, clasp, spring-release, cotter pin, or any other mechanism known in the art. When vehicle visor measuring and cutting apparatus 100 is in use, measuring component attachment 46 is adjusted to the desired distance from contour guide 20 and removed across windshield and window film, cutting or marking window film at a uniform distance while compensating for arc in the windshield.

In the embodiment shown in FIG. 1, implement holder component 40 is slidably attached and positioned substantially perpendicularly to measuring component 10. However, implement holder component 40 may also be securely attached at varying angles in relation to measuring component 10, and may be pivotally attached to allow different cutting or measuring angles for optimal cutting or measuring, as well as for easy storage when not in use.

In the embodiment shown in FIG. 1, contour guide 20 is securely attached to the top end of measuring component 10, and is a protuberance that extends substantially perpendicularly from the top end of measuring component 10 in the same direction as implement 44, so both contour guide 20 and cutting implement 44 move along the same plane while vehicle visor measuring and cutting apparatus 100 is in use. In the exemplary embodiment, contour guide 20 extends ½ inch from measuring component 10; however, in alternate embodiments, contour guide 20 may be of varying shapes and proportions, and may be positioned at various locations along measuring component 10. Contour guide 20 is designed to be positioned and move easily along a vehicle's window molding, which acts as a stabilizing guide, and to rest upon and be moved along the windshield molding. In the exemplary embodiment, contour guide 20 rests upon the windshield and against the lower edge of windshield molding, but in alternate embodiments, may rest on the upper edge of windshield molding and car frame, with implement holder component 40 is adjusted according to the placement of contour guide 20.

In the embodiment shown in FIG. 1, contour guide 20 has a rounded edge to enable easy movement along windshield and molding. In alternate embodiments, contour guide may have straight or contoured edges, or may contain a separate rolling component such as a ball bearing or a wheel that allows for movement along windshield and molding. In the exemplary embodiment shown in FIG. 1, contour guide 20 is made from semi-firm rubber, but in alternate embodiments may be made from materials such as metals, composites, alloys, plastics, etc., and may contain padding or covering to protect contour guide 20 and also to protect windshield and molding.

FIG. 1 also illustrates handle 30, which in the exemplary embodiment positioned substantially perpendicular to measuring component 10 and is attached to measuring component 10 by handle attachment 32. In the exemplary embodiment, handle 30 is cylindrical, but in alternate embodiments may be rectangular, conical, tapered, have gripping features, be ergonomically designed, etc., and may be made from rubber, metal, plastics, composites or variations thereof known in the art.

In the embodiment shown in FIG. 1, handle 30 is slidably attached substantially perpendicularly to measuring component 10. However, it will be evident to those in the art that handle 30 may be secured at different angles relative to measuring component 10 for user comfort, and may be pivotally attached to allow for easy storage when vehicle visor measuring and cutting apparatus 100 is not in use. Handle 30 may also be pivotally attached to measuring component 10 to facilitate storage. Additionally, implement holder 40 may be pivotally attached for storage. is optional, and may be left out in certain embodiments where vehicle visor measuring and cutting apparatus 100 is part of a larger, mechanized apparatus with preset cutting dimensions.

As also shown in the embodiment in FIG. 1, handle attachment 32 is slidably attached to measuring component 10 and is also securely attached to handle 30. In the exemplary embodiment, handle attachment 32 is molded plastic, but in alternate embodiments can be made from steel or other metals, composites, alloys, or any other material that securely holds and allows for slidably adjustment against measuring component 10. In the embodiment shown in FIG. 1, handle attachment 32 is adjusted with an adjustable locking screw or set screw 48, but in alternate embodiments, may be any securely adjustable mechanism such as a clip, clasp, spring-release, cotter pin, or any other mechanism known in the art.

Figure 2:
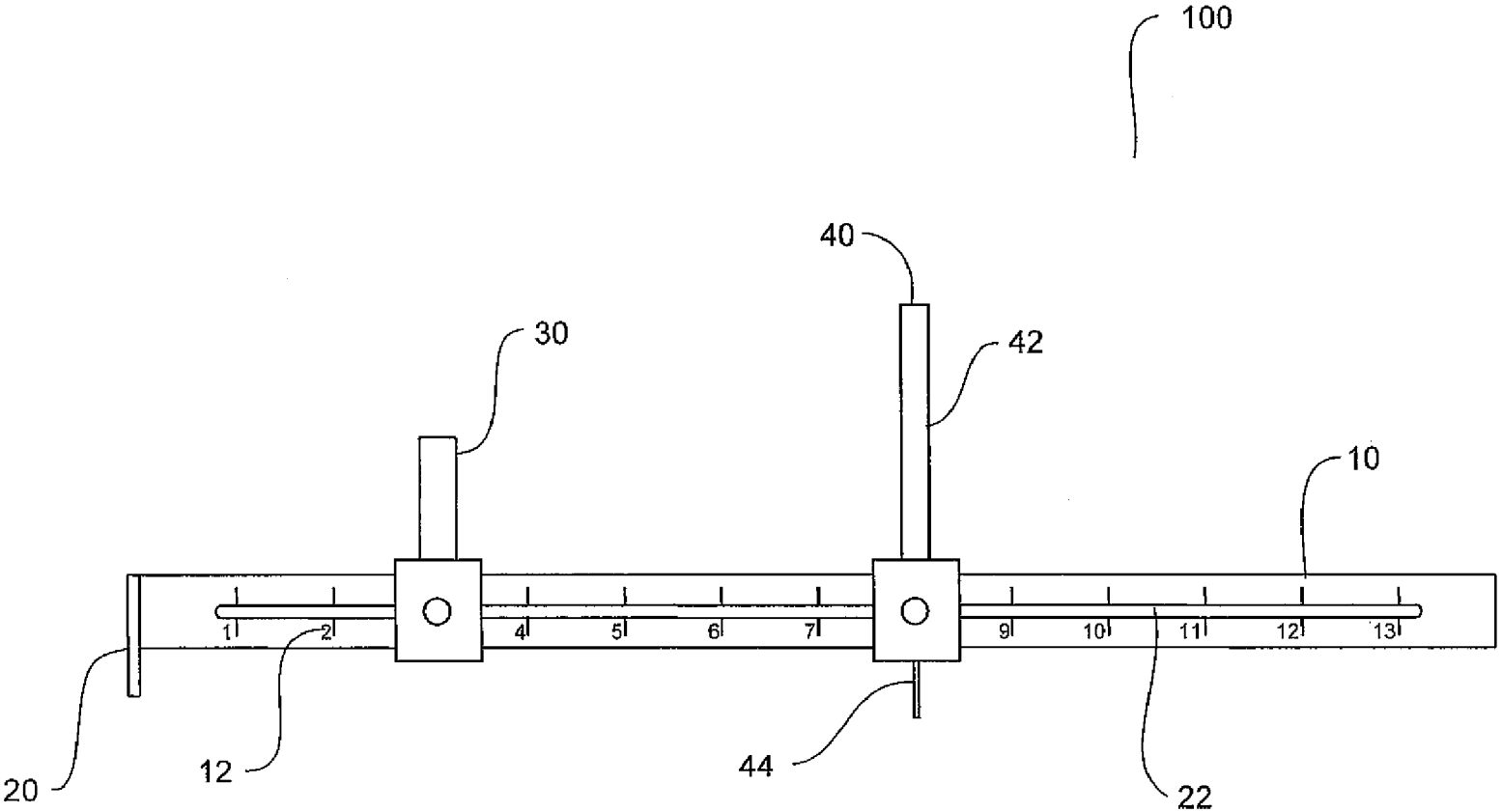
FIG. 2 shows a front view of one embodiment of the vehicle visor measuring and cutting apparatus.

The embodiment shown in FIG. 2 shows a front view of one embodiment of the vehicle visor measuring and cutting apparatus. In the exemplary embodiment, contour guide 20 and implement 44 are shown extended from one side of measuring component 10, while handle 30 and implement casing 42 extend from another side. In the exemplary embodiment, implement holder component 40 is adjusted horizontally along measuring component 10 in relation to contour guide 20 to obtain the desired dimensions of window film. Implement 44 can also be adjusted vertically to compensate for different windshield contours or arcs, as well as different thickness and shapes of window film.

As illustrated in FIG. 2, measurement component 10 further includes slot 22 to allow quick adjustment of implement attachment 46 and handle attachment 32 along the same plane in measuring component 10. In the exemplary embodiment, slot 22 is centered in measuring component 10, but in alternate embodiments may be positioned anywhere in, on top or below measuring component 10. It will be evident to one in the art that slot 22 may be of varying sizes and dimensions to facilitate adjustment of handle attachment 32 and attachment component 46.

In alternative embodiments, implement holder 40 may be configured or adapted to serve as a second handle to increase stability and provide additional leverage and force for cutting.

What is claimed is:

1. A vehicle visor tool comprised of:

a measuring component having an elongated body and an first end and a second end;

a contour guide capable of being moved along a path that corresponds to the vehicle windshield molding, at least one handle; and an implement holder fixably attached to said measuring component into which an implement for measuring is inserted.

2. The vehicle visor tool of claim 1, wherein said implement holder may be selectively positioned along said measuring component.

3. The vehicle visor tool of claim 1, wherein said handle may be selectively positioned along said measuring component.

4. The vehicle visor of claim 1 wherein said implement holder is adapted to receive an implement selected from a group consisting of a knife, a cutting tool, a laser cutter, a marking tool, a rotary cutting device and a razor.

5. The vehicle visor tool of claim 1 wherein said contour guide is comprised of a protuberance having a rounded end, and wherein said contour guide is attached to said first end of said measuring component.

6. The vehicle visor tool of claim 1, wherein said measuring component contains at least one measurement marking.

7. The vehicle visor tool of claim 1, which includes a first handle, and wherein said implement holder is adapted to function as a second handle.

8. The visor-cutting tool of claim 1, wherein said implement holder and said handle are pivotally secured to said measuring component and collapsible for storage.

9. The measuring and cutting apparatus of claim 1, wherein said contour guide includes a gliding component.

10. An apparatus for cutting window film to the desired dimensions on the windshield of a vehicle comprising:

a measuring component having an elongated body and an upper end and lower end and at least one measurement marking;

a contour guide comprised of a protuberance having a rounded end component which is fixably attached to the top end said measuring component, said contour guide and capable of being moved along a path which corresponds to the vehicle windshield molding;

a handle; and an implement holder fixably into which a cutting implement is inserted.

11. The measuring and cutting apparatus of claim 10, wherein said measuring component contains at least one measurement marking to allow cutting of visors to conform with dimensions determined by a plurality of standard window film width allowances check term.

12. The measuring and cutting apparatus of claim 10, wherein said implement holder and said handle are pivotally secured to said measuring component and collapsible for storage.

13. The measuring and cutting apparatus of claim 12, wherein said contour guide includes a ball bearing that rolls along the window molding of a vehicle.

14. The measuring and cutting apparatus of claim 12, wherein said contour guide includes a gliding member.

15. The vehicle visor tool of claim 12 wherein said contour guide is comprised of a protuberance having a rounded end, said contour guide being fixably attached to said first end of said measuring component.

16. The vehicle visor tool of claim 12, wherein said measuring component contains at least one measurement marking.

17. The vehicle visor tool of claim 12, wherein said implement holder may be selectively positioned along said measuring component.

18. The vehicle visor tool of claim 12, wherein said handle component may be selectively positioned along said measuring component.

19. The visor cutting tool of claim 12, wherein said implement holder and said handle are pivotally secured to said measuring component and collapsible for storage.

20. A method of using a vehicle measuring and cutting apparatus including the steps of:

positioning a section window film over a vehicle windshield;

mounting a contour guide to a measuring component at a first end of said measuring component;

mounting a handle to said measuring component;

mounting a cutting implement to said measuring component;

adjusting the position of said cutting implement to correspond to the desired with of a vehicle visor;

positioning said contour guide the windshield molding at the top edge of said vehicle windshield; and gliding said contouring tool along the upper molding of a windshield while cutting said window film to desired dimensions.

* * * * *